US005997466A

United States Patent [19]

Adams et al.

[11] Patent Number: 5,997,466

[45] **Date of Patent: *Dec. 7, 1999**

[54] IMPLANTABLE HEARING SYSTEM HAVING MULTIPLE TRANSDUCERS

[75] Inventors: Theodore P. Adams, Edina; Kai Kroll, Minnetonka, both of Minn.

[73] Assignee: St. Croix Medical, Inc., Minneapolis, Minn.

[ * ] Notice: This patent issued on a continued prosecution application filed under 37 CFR 1.53(d), and is subject to the twenty year patent term provisions of 35 U.S.C. 154(a)(2).

[21] Appl. No.: 08/693,430

[22] Filed: Aug. 7, 1996

[51] Int. Cl.[6] ..... H04R 25/00

[52] U.S. Cl. ..... 600/25

[58] Field of Search ..... 181/135; 600/25

[56] References Cited

U.S. PATENT DOCUMENTS

| | | | |
|---|---|---|---|
| 3,557,775 | 1/1971 | Mahoney . | |
| 3,594,514 | 7/1971 | Wingrove | 600/25 |
| 3,712,962 | 1/1973 | Epley | 600/25 |
| 3,764,748 | 10/1973 | Branch et al. . | |
| 3,931,648 | 1/1976 | Shea . | |
| 4,729,366 | 3/1988 | Schaefer . | |
| 4,774,933 | 10/1988 | Hough et al. | 600/25 |
| 4,776,322 | 10/1988 | Hough et al. . | |
| 4,817,607 | 4/1989 | Tatge . | |
| 4,840,178 | 6/1989 | Heide et al. . | |
| 4,850,962 | 7/1989 | Schaefer | 600/25 |
| 4,957,478 | 9/1990 | Maniglia | 600/25 |
| 5,012,520 | 4/1991 | Steeger | 381/68 |
| 5,015,224 | 5/1991 | Maniglia | 600/25 |
| 5,015,225 | 5/1991 | Hough et al. | 600/25 |
| 5,163,957 | 11/1992 | Sade et al. | 623/10 |
| 5,277,694 | 1/1994 | Leysieffer et al. | 600/25 |
| 5,282,858 | 2/1994 | Bisch et al. | 623/10 |
| 5,338,287 | 8/1994 | Miller et al. | 600/25 |
| 5,360,388 | 11/1994 | Spindel et al. | 600/25 |
| 5,411,467 | 5/1995 | Hortmann et al. | 600/25 |
| 5,456,654 | 10/1995 | Ball | 600/25 |
| 5,498,226 | 3/1996 | Lenkauskas | 600/25 |

(List continued on next page.)

FOREIGN PATENT DOCUMENTS 2 303 194 7/1974 Germany .

OTHER PUBLICATIONS

"Middle Ear Implant: Implantable Hearing Aids", *Advances in Audiology, vol. 4, M. Hoke Series Editor*, Karger, 1–169, (1988).

T. Dumon, et al., "Piezoelectric Middle Ear Implant: Experimental Results", *Abstract of Paper Presented at International Symposium on Electronic Implants in Otology and Conventional Hearing Aids*, Walt Disney World Swan, Abstract #35, (Nov. 11–14, 1996).

J. M. Frederickson, et al., "Ongoing Investigations into an Implantable Electromagnetic Hearing Aid for Moderate to Severe Sensorineural Hearing Loss", *Otolaryngological Clinics of North America, vol. 28, No. 1*, 107–121, (Feb. 1995).

(List continued on next page.)

*Primary Examiner*—Samuel Gilbert

*Attorney, Agent, or Firm*—Patterson & Keough, P.A.

[57] ABSTRACT

A method and apparatus for improving a frequency response of a piezoelectric input or output transducer in an implantable hearing system. Multiple input or multiple output transducers obtain optimized mechanical-to-electrical or electrical-to-mechanical frequency response. Output mechanical coupling is directly to the inner ear, or through an ossicular element such as the malleus, stapes, or incus. Input mechanical vibrations are obtained from an auditory element such as the tympanic membrane, malleus, or incus. Substantially nonidentical frequency responses are obtained such as using transducers of different dimensions, different number of transducer elements, different material properties, different mounting techniques, or different auditory elements for coupling.

16 Claims, 12 Drawing Sheets

U.S. PATENT DOCUMENTS

| | | | |
|---|---|---|---|
| 5,531,787 | 7/1996 | Lesinski et al. | 623/10 |
| 5,554,096 | 9/1996 | Ball | 600/25 |
| 5,624,376 | 4/1997 | Ball et al. | 600/25 |
| 5,800,336 | 9/1998 | Ball et al. . | |

OTHER PUBLICATIONS

K. Gyo, et al., "Sound Pickup Utilizing an Implantable Piezpelectric Ceramic Bimorph Element: Application to the Cochlear Implant", *American Journal of Otology, vol. 5, No. 4*, 273–276, (Apr. 1984).

K. Gyo, et al., "Stapes Vibration Produced by the Output Transducer of an Implantable Hearing Aid", *Arch Otolaryngol Head Neck Surg., vol. 113*, 1078–1081, (Oct. 1987).

G. Jako, "Biomedical Engineering in Ear Surgery", *Otolaryngological Clinics of North America, vol. 5, No. 1*, 173–182, (Feb. 1972).

Wen H. Ko, et al., "Engineering Principles of Mechanical Stimulation of the Middle Ear", *Otolaryngological of North America, vol. 28, No. 1*, 29–41, (Feb. 1995).

K. Kodera, et al., "Sound Evaluation of Partially Implantable Piezoelectric Middle Ear Implant: Comparative Study of Frequency Responses", *ENT Journal, vol. 73, No. 2*, 108–111, (Feb. 1994).

A. J. Maniglia, et al., "A Contactless Electromagnetic Implantable Middle Ear Device for Sensorineural Hearing Loss", *ENT Journal, vol. 73, No. 2*, 78–90 (Feb. 1994).

A. J. Maniglia, et al., "Contactless, Semi–Implantable Electromagnetic Hearing Device for the Treatment of Sensorineural Hearing Loss", *Abstract of Paper Presented at Internatioanl Symposium on Electronic Implants in Otology and Conventional Hearing Aids*, Walt Disney World Swan, Abstract #29, (Nov. 11–14, 1993).

Jun–Ichi Suzuki, et al., "Long–Term Clinical Results of the Partially Implantable Piezoelectric Middle Ear Implant", *ENT Journal, vol. 73, No. 2*, 104–107, (Feb. 1994).

M. Tos, et al., "Implantation of Electromagnetic Ossicular Replacement Device", *ENT Journal, vol. 73, No. 2*, 93–103, (Feb. 1994).

D. B. Welling, et al., "Auditory Stimulation of the Inner Ear via the Semicircular Canals", *Abstract of paper presented at International Symposium on Electronic Implants in Otology and Conventional Hearing Aids*, Walt Disney World Swan, Abstract #9, (Nov. 11–14, 1993).

N. Yanagihara, et al., "Partially Implantable Hearing Aid using Piezoelectric Ceramic Ossicular Vibrator", *Abstract of Paper Presented at International Symposium on Electronic Implants in Otology and Conventional Hearing Aids*, Walt Disney World Swan, Abstract #26, (Nov. 11–14, 1993).

IMPLANTABLE HEARING SYSTEM HAVING MULTIPLE TRANSDUCERS

THE FIELD OF THE INVENTION

This invention relates to electromechanical transducers in a hearing system at least partially implantable in a middle ear.

BACKGROUND

In some types of partial middle ear implantable (P-MEI) or total middle ear implantable (T-MEI) hearing aid systems, sounds produce mechanical vibrations which are transduced by an electromechanical input transducer into electrical signals. These electrical signals are in turn amplified and applied to an electromechanical output transducer. The electromechanical output transducer vibrates an ossicular bone in response to the applied amplified electrical signals, thereby improving hearing.

Such electromechanical input and output transducers should be proportioned to provide convenient implantation in the middle ear. Low power consumption transducers are also desired for use with a limited longevity implanted battery as a power source. The electromechanical input transducer should have high sensitivity, gain, linearity, and a wide dynamic range in producing electrical signals from a sensed mechanical vibration. The electromechanical output transducer should have low power consumption in producing mechanical vibrations from an applied electrical input signal.

SUMMARY OF THE INVENTION

A method and apparatus for transducing between electrical signals and mechanical vibrations in an ear is described. Electromechanical frequency responses are improved by using multiple electromechanical transducers having substantially nonidentical frequency responses.

Electrical signals, such as from a single amplifier or from multiple amplifiers, are transduced into mechanical vibrations by electromechanical transducers having substantially nonidentical electrical-to-mechanical frequency responses. A superposition of the mechanical vibrations is delivered to the inner ear either directly at the oval window, round window, vestibule, or semicircular canals, or by coupling the mechanical vibration through connection elements or auditory elements such as ossicles.

Mechanical vibrations, such as from auditory elements including the tympanic membrane, the malleus, and the incus, are transduced into electrical signals by electromechanical transducers having substantially nonidentical mechanical-to-electrical frequency responses. Such electrical signals are provided to an electronics unit of a hearing system for superpositioning or other further processing.

The invention discloses electromechanical transducers comprising piezoelectric ceramic single element transducers, piezoelectric ceramic bi-element transducers, piezoelectric film transducers, piezoelectric film bi-element transducers, and mechanically stacked piezoelectric ceramic transducers.

The substantially nonidentical frequency responses of the plurality of transducers is obtained, for example, by using transducers of different physical dimensions, different number of transducer elements, different material properties, different auditory elements to which they are coupled, different mounting techniques, or any other technique.

Thus, the present invention discloses a method and apparatus for improving a frequency response of a piezoelectric transducer in an implantable hearing system. The present invention configures a plurality of piezoelectric transducers having substantially nonidentical frequency responses. A combined frequency response effected by the plurality of piezoelectric transducers is thereby optimized.

BRIEF DESCRIPTION OF THE DRAWINGS

In the drawings, like numerals describe like components throughout the several views.

DETAILED DESCRIPTION

Figure 1:
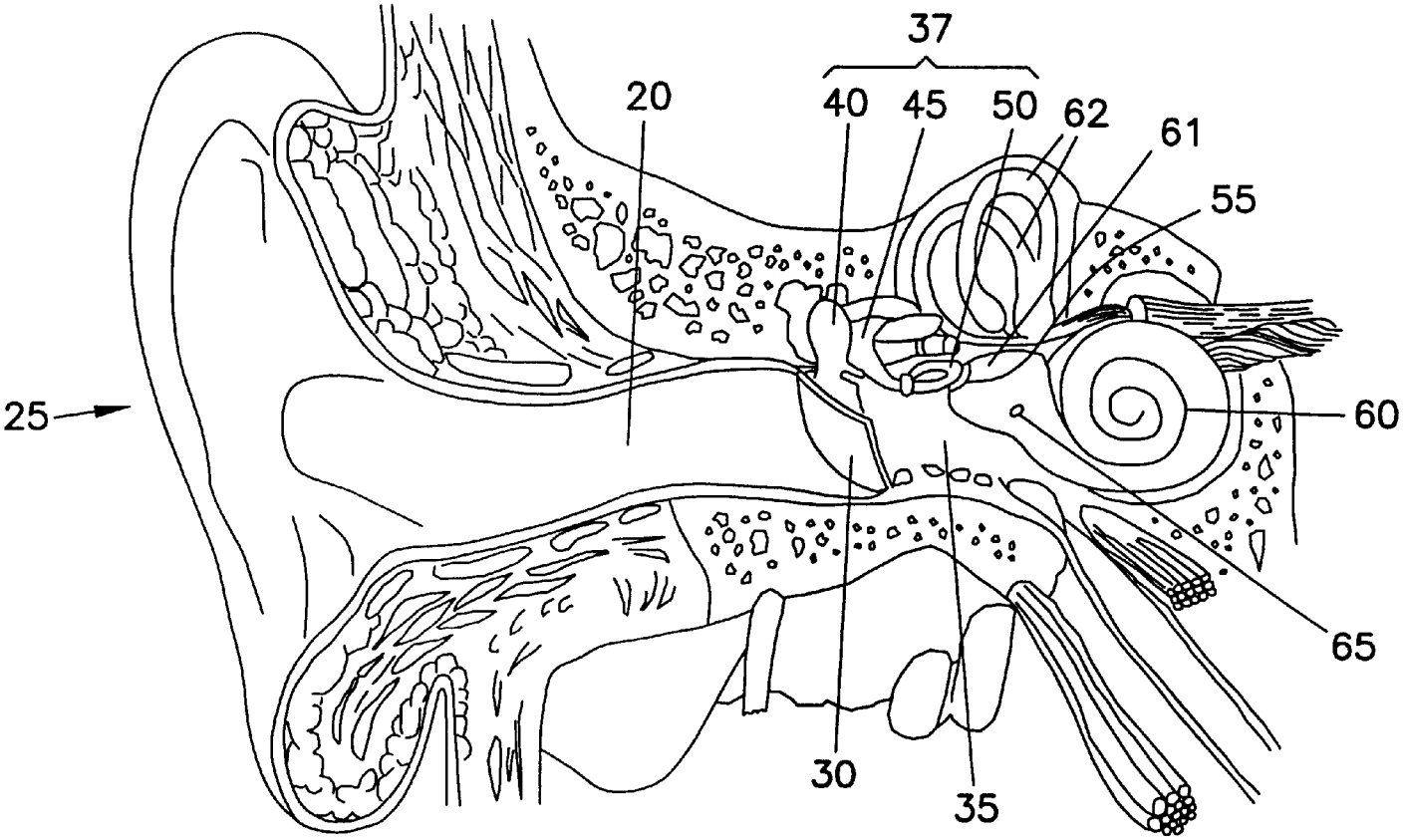
FIG. 1 illustrates a frontal section of an anatomically normal human right ear.

The invention provides an electromechanical transducer method and apparatus which is particularly advantageous when used in a middle ear implantable hearing system such as a partial middle ear implantable (P-MEI), total middle ear implantable (T-MEI), or other hearing aid system. A P-MEI or T-MEI hearing aid system assists the human auditory system in converting acoustic energy contained within sound waves into electrochemical signals delivered to the brain and interpreted as sound. FIG. 1 illustrates generally the use of the invention in a human auditory system. Sound waves are directed into an external auditory canal 20 by an outer ear (pinna) 25. The frequency characteristics of the sound waves are slightly modified by the resonant characteristics of the external auditory canal 20. These sound waves impinge upon the tympanic membrane (eardrum) 30, interposed at the terminus of the external auditory canal 20, between it and the tympanic cavity (middle ear) 35. Variations in the sound waves produce tympanic vibrations. The mechanical energy of the tympanic vibrations is communicated to the inner ear, comprising cochlea 60, vestibule 61, and semicircular canals 62, by a sequence of articulating bones located in the middle ear 35. This sequence of articulating bones is referred to generally as the ossicular chain 37. Thus, the tympanic membrane 30 and ossicular chain 37 transform acoustic energy in the external auditory canal 20 to mechanical energy at the cochlea 60.

The ossicular chain 37 includes three primary components: a malleus 40, an incus 45, and a stapes 50. The malleus 40 includes manubrium and head portions. The manubrium of the malleus 40 attaches to the tympanic membrane 30. The head of the malleus 40 articulates with one end of the incus 45. The incus 45 normally couples mechanical energy from the vibrating malleus 40 to the stapes 50. The stapes 50 includes a capitulum portion, comprising a head and a neck, connected to a footplate portion by means of a support crus comprising two crura. The stapes 50 is disposed in and against a membrane-covered opening on the cochlea 60. This membrane-covered opening between the cochlea 60 and middle ear 35 is referred to as the oval window 55. Oval window 55 is considered part of cochlea 60 in this patent application. The incus 45 articulates the capitulum of the stapes 50 to complete the mechanical transmission path.

Normally, prior to implantation of the invention, tympanic vibrations are mechanically conducted through the malleus 40, incus 45, and stapes 50, to the oval window 55. Vibrations at the oval window 55 are conducted into the fluid-filled cochlea 60. These mechanical vibrations generate fluidic motion, thereby transmitting hydraulic energy within the cochlea 60. Pressures generated in the cochlea 60 by fluidic motion are accommodated by a second membrane-covered opening on the cochlea 60. This second membrane-covered opening between the cochlea 60 and middle ear 35 is referred to as the round window 65. Round window 65 is considered part of cochlea 60 in this patent application. Receptor cells in the cochlea 60 translate the fluidic motion into neural impulses which are transmitted to the brain and perceived as sound. However, various disorders of the tympanic membrane 30, ossicular chain 37, and/or cochlea 60 can disrupt or impair normal hearing.

Hearing loss due to damage in the cochlea is referred to as sensorineural hearing loss. Hearing loss due to an inability to conduct mechanical vibrations through the middle ear is referred to as conductive hearing loss. Some patients have an ossicular chain 37 lacking sufficient resiliency to transmit mechanical vibrations between the tympanic membrane 30 and the oval window 55. As a result, fluidic motion in the cochlea 60 is attenuated. Thus, receptor cells in the cochlea 60 do not receive adequate mechanical stimulation. Damaged elements of ossicular chain 37 may also interrupt transmission of mechanical vibrations between the tympanic membrane 30 and the oval window 55.

Various techniques have been developed to remedy hearing loss resulting from conductive or sensorineural hearing disorder. For example, tympanoplasty is used to surgically reconstruct the tympanic membrane 30 and establish ossicular continuity from the tympanic membrane 30 to the oval window 55. Various passive mechanical prostheses and implantation techniques have been developed in connection with reconstructive surgery of the middle ear 35 for patients with damaged elements of ossicular chain 37. Two basic forms of prosthesis are available: total ossicular replacement prostheses (TORP), which is connected between the tympanic membrane 30 and the oval window 55; and partial ossicular replacement prostheses (PORP), which is positioned between the tympanic membrane 30 and the stapes 50.

Various types of hearing aids have been developed to compensate for hearing disorders. A conventional "air conduction" hearing aid is sometimes used to overcome hearing loss due to sensorineural cochlear damage or mild conductive impediments to the ossicular chain 37. Conventional hearing aids utilize a microphone, which transduces sound into an electrical signal. Amplification circuitry amplifies the electrical signal. A speaker transduces the amplified electrical signal into acoustic energy transmitted to the tympanic membrane 30. However, some of the transmitted acoustic energy is typically detected by the microphone, resulting in a feedback signal which degrades sound quality. Conventional hearing aids also often suffer from a significant amount of signal distortion.

Implantable hearing aid systems have also been developed, utilizing various approaches to compensate for hearing disorders. For example, cochlear implant techniques implement an inner ear hearing aid system. Cochlear implants electrically stimulate auditory nerve fibers within the cochlea 60. A typical cochlear implant system includes an external microphone, an external signal processor, and an external transmitter, as well as an implanted receiver and an implanted single channel or multichannel probe. A single channel probe has one electrode. A multichannel probe has an array of several electrodes. In the more advanced multichannel cochlear implant, a signal processor converts speech signals transduced by the microphone into a series of sequential electrical pulses corresponding to different frequency bands within a speech frequency spectrum. Electrical pulses corresponding to low frequency sounds are delivered to electrodes that are more apical in the cochlea 60. Electrical pulses corresponding to high frequency sounds are delivered to electrodes that are more basal in the cochlea 60 The nerve fibers stimulated by the electrodes of the cochlear implant probe transmit neural impulses to the brain, where these neural impulses are interpreted as sound.

Other inner ear hearing aid systems have been developed to aid patients without an intact tympanic membrane 30, upon which "air conduction" hearing aids depend. For example, temporal bone conduction hearing aid systems produce mechanical vibrations that are coupled to the cochlea 60 via a temporal bone in the skull. In such temporal bone conduction hearing aid systems, a vibrating element can be implemented percutaneously or subcutaneously.

A particularly interesting class of hearing aid systems includes those which are configured for disposition principally within the middle ear 35 space. In middle ear implantable (MEI) hearing aids, an electrical-to-mechanical output transducer couples mechanical vibrations to the ossicular chain 37, which is optionally interrupted to allow coupling of the mechanical vibrations to the ossicular chain 37. Both electromagnetic and piezoelectric output transducers have been used to effect the mechanical vibrations upon the ossicular chain 37.

One example of a partial middle ear implantable (P-MEI) hearing aid system having an electromagnetic output transducer comprises: an external microphone transducing sound into electrical signals; external amplification and modulation circuitry; and an external radio frequency (RF) transmitter for transdermal RF communication of an electrical signal. An implanted receiver detects and rectifies the transmitted signal, driving an implanted coil in constant current mode. A resulting magnetic field from the implanted drive coil vibrates an implanted magnet that is permanently affixed only to the incus 45. Such electromagnetic output transducers have relatively high power consumption, which limits their usefulness in total middle ear implantable (T-MEI) hearing aid systems.

A piezoelectric output transducer is also capable of effecting mechanical vibrations to the ossicular chain 37. An example of such a device is disclosed in U.S. Pat. No. 4,729,366, issued to D. W. Schaefer on Mar. 8, 1988. In the '366 patent, a mechanical-to-electrical piezoelectric input transducer is associated with the malleus 40, transducing mechanical energy into an electrical signal, which is amplified and further processed. A resulting electrical signal is provided to an electrical-to-mechanical piezoelectric output transducer that generates a mechanical vibration coupled to an element of the ossicular chain 37 or to the oval window 55 or round window 65. In the '366 patent, the ossicular chain 37 is interrupted by removal of the incus 45. Removal of the incus 45 prevents the mechanical vibrations delivered by the piezoelectric output transducer from mechanically feeding back to the piezoelectric input transducer.

Piezoelectric output transducers have several advantages over electromagnetic output transducers. The smaller size or volume of the piezoelectric output transducer advantageously eases implantation into the middle ear 35. The lower power consumption of the piezoelectric output transducer is particularly attractive for T-MEI hearing aid systems, which include a limited longevity implanted battery as a power source.

However, some researchers have found the frequency response of piezoelectric output transducers to be poor in comparison with electromagnetic output transducers. See e.g. W. H. Ko, et. al., "Engineering Principles of Mechanical Stimulation of the Middle Ear, *Otolaryngologic Clinics of North America,* Vol. 28, No. 1, Feb. 1995. Thus, there is a need for improving the frequency response of the piezoelectric output transducer in a middle ear implantable hearing aid system.

To address this need, this invention is directed primarily toward improving a frequency response of a piezoelectric output transducer in a P-MEI, T-MEI, or other hearing system. However, the invention is also applicable to improving a frequency response of a piezoelectric input transducer. In one embodiment, a ceramic piezoelectric bi-element transducer is used. Such a bi-element transducer comprises a cantilevered double plate ceramic element in which two plates are bonded together such that they amplify a piezoelectric action in a direction approximately normal to the bonding plane. A bi-element output transducer vibrates according to a potential difference applied between two bonded plates. A bi-element input transducer produces a potential difference across the two bonded plates in response to a vibration.

Figure 2:
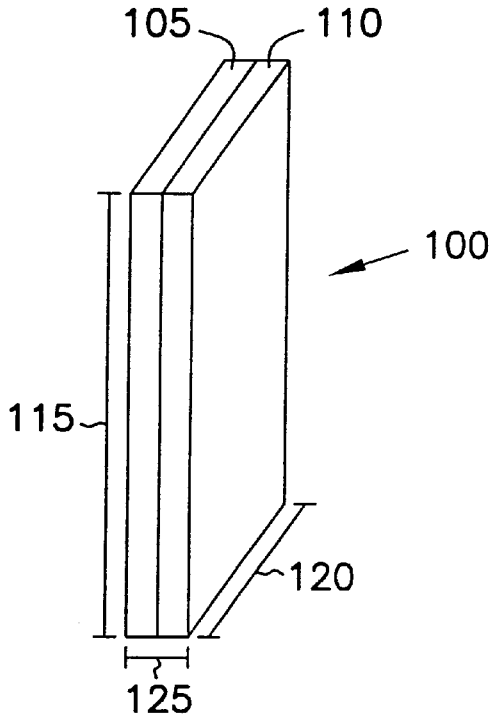
FIG. 2 illustrates physical dimensions of a bi-element transducer.

A three dimensional structure of a bi-element transducer 100 is illustrated generally in FIG. 2. The bi-element transducer 100 comprises a first piezoelectric element 105 and a second piezoelectric element 110 that are bonded together such as by gluing or hot pressing. The bi-element transducer 100 has physical dimensions comprising a length 115, a width 120, and a thickness 125.

Figure 3:
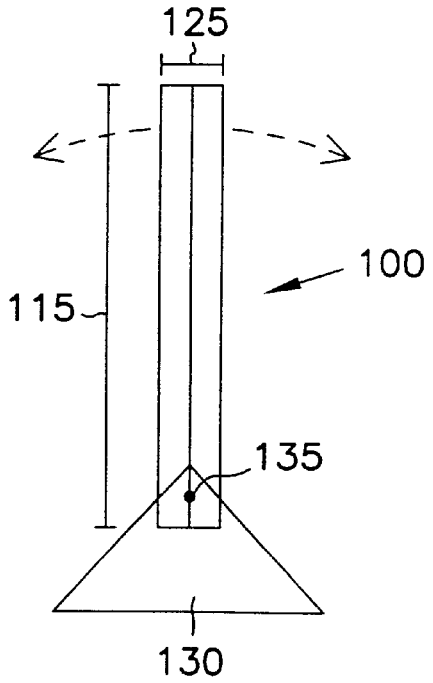
FIG. 3 illustrates the mechanical vibration of a bi-element transducer affixed at a proximal end.

In the two dimensional illustration of FIG. 3, a proximal end of a bi-element transducer 100 is affixed to a fixed base 130 at axis 135, wherein axis 135 is understood to be orthogonal to the plane of the illustration. Applying a voltage signal between the first and second piezoelectric elements 105 and 110 respectively, at any convenient connection locations, results in a flexing of the bi-element transducer 100, thereby effecting a mechanical vibration around the axis 135. The mechanical vibration results in a vibratory displacement of a distal end of bi-element transducer 100 as illustrated by the dashed arrows in FIG. 3.

A bi-element transducer configured as illustrated in FIG. 3 has both a characteristic sensitivity and frequency response with respect to a voltage input. The characteristic sensitivity is defined as the vibratory displacement of the distal end of the bi-element transducer 100 for a given voltage input. An unloaded bi-element transducer 100 displays a lowpass frequency response having a frequency bandwidth (bandwith) determined by a characteristic upper cutoff frequency in the audio frequency range of interest and also displays a slight resonance near the upper cutoff frequency. Mechanical coupling of the bi-element transducer 100 such as to an ossicular element of the ossicular chain 37 loads the bi-element transducer 100, altering its sensitivity, bandwidth, and resonance characteristics.

The sensitivity, bandwidth, and resonance are also altered by modifying the physical dimensions of the bi-element transducer 100. By decreasing the thickness 125 of the bi-element transducer 100, the sensitivity is increased. By increasing the length 115 of the bi-element transducer 100, the sensitivity is increased, but the bandwidth is decreased. Conversely, by decreasing the length 115 of the bi-element transducer 100, the sensitivity is decreased, but the bandwidth is increased. Thus, it is difficult to increase both the sensitivity and bandwidth of a bi-element transducer 100 by altering its length 115.

For good speech comprehension, an output range between 0 and 90 decibels is needed in the frequency range approximately between 250 hertz and 5 kilohertz. As described above, these parameters are difficult to obtain from a piezoelectric output transducer. The invention configures a plurality of piezoelectric output transducers having substantially nonidentical bandwidths. This optimizes a combined bandwidth of the plurality of transducers. A plurality of piezoelectric input transducers are similarly used for the same advantage. Nonidentical bandwidths are obtained by using transducers of different physical dimensions, different material properties, different mounting methods, or any other technique of implementing nonidentical bandwidths.

Figure 4:
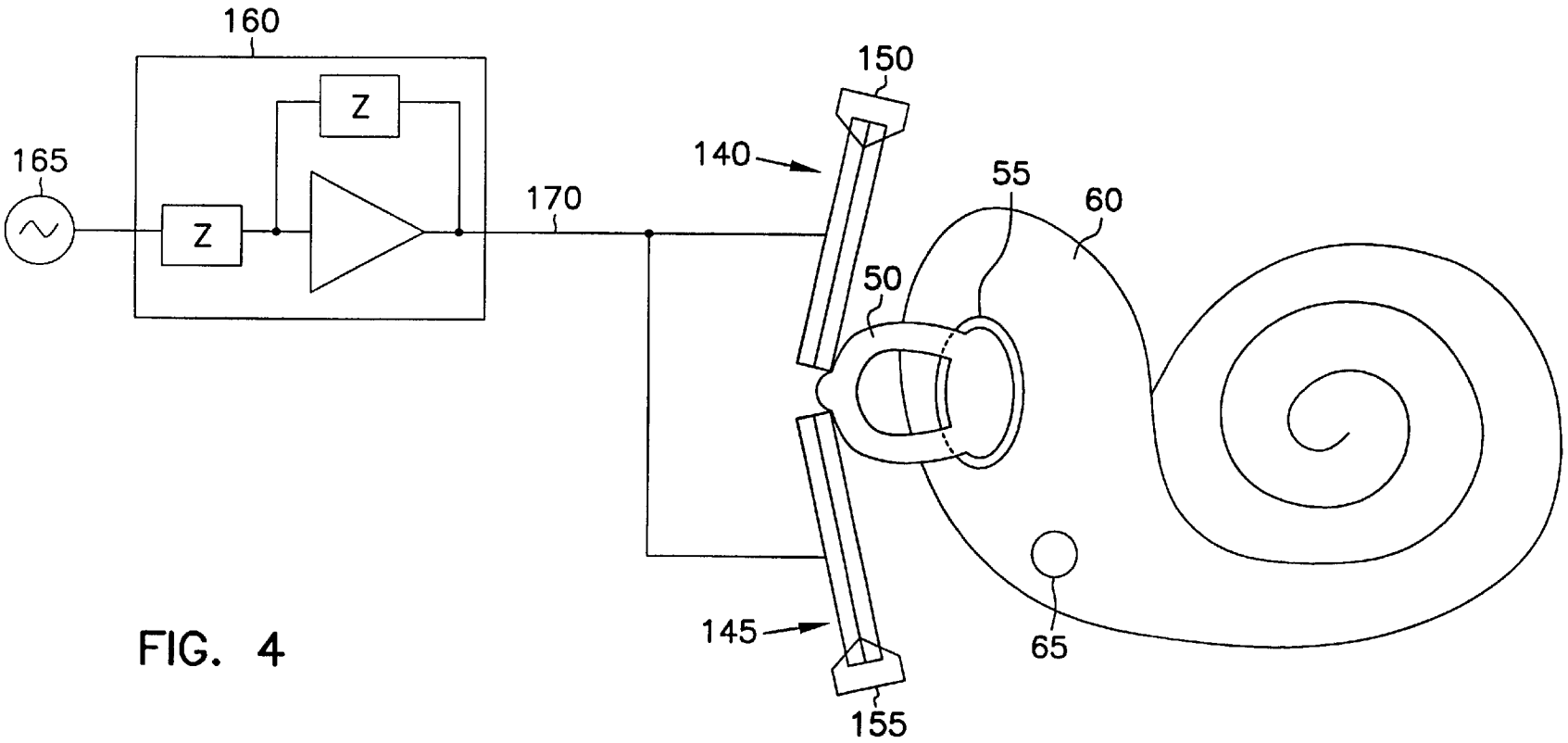
FIG. 4 illustrates generally direct mechanical coupling to an auditory element such as the stapes by multiple piezoelectric transducers driven by a single amplifier.

FIG. 4 illustrates generally one embodiment of the invention, in which a plurality of piezoelectric output transducers vibrate an element of ossicular chain 37. First and second piezoelectric transducers 140 and 145 are disposed within middle ear 35. In one embodiment, first and second piezoelectric transducers 140 and 145 comprise bi-element transducers attached to first and second base fixtures 150 and 155, which are each secured to the temporal bone. However, other piezoelectric transducers may also be used, such as, for example: ceramic piezoelectric single element transducers; mechanically stacked ceramic piezoelectric elements wired electrically in parallel for more vibratory displacement; or a highly piezoelectric film such as a polarized fluoropolymer, e.g. polyvinylidene fluoride (PVDF). For example, a PVDF film such as that sold under the trademark "Kynar" by AMP, Inc., of Harrisburg, Pa., may be used.

In FIG. 4, first and second piezoelectric transducers 140 and 145 each contact an element of ossicular chain 37, more particularly the stapes 50. Mechanical vibrations of the first and second piezoelectric transducers 140 and 145 are coupled through stapes 50 to oval window 55 portion of cochlea 60. In one embodiment, first and second piezoelectric transducers 140 and 145 have substantially nonidentical bandwidths, as described above, each contributing to a combined bandwidth of the mechanical vibration of stapes 50.

FIG. 4 schematically illustrates one embodiment in which amplifier 160 amplifies an input electrical signal 165 and provides an amplified input electrical signal at signal node 170 identically provided to each of first and second piezoelectric transducers 140 and 145. Signal node 170 generically represents both single-ended and differential signals applied to one or more elements of each of first and second transducers 140 and 145, as described above. The input electrical connection of signal node 170 is by lead wires, or incorporated into the physical structure of each of first and second base fixtures 150 and 155, or by any other convenient electrical connection technique.

Figure 5:
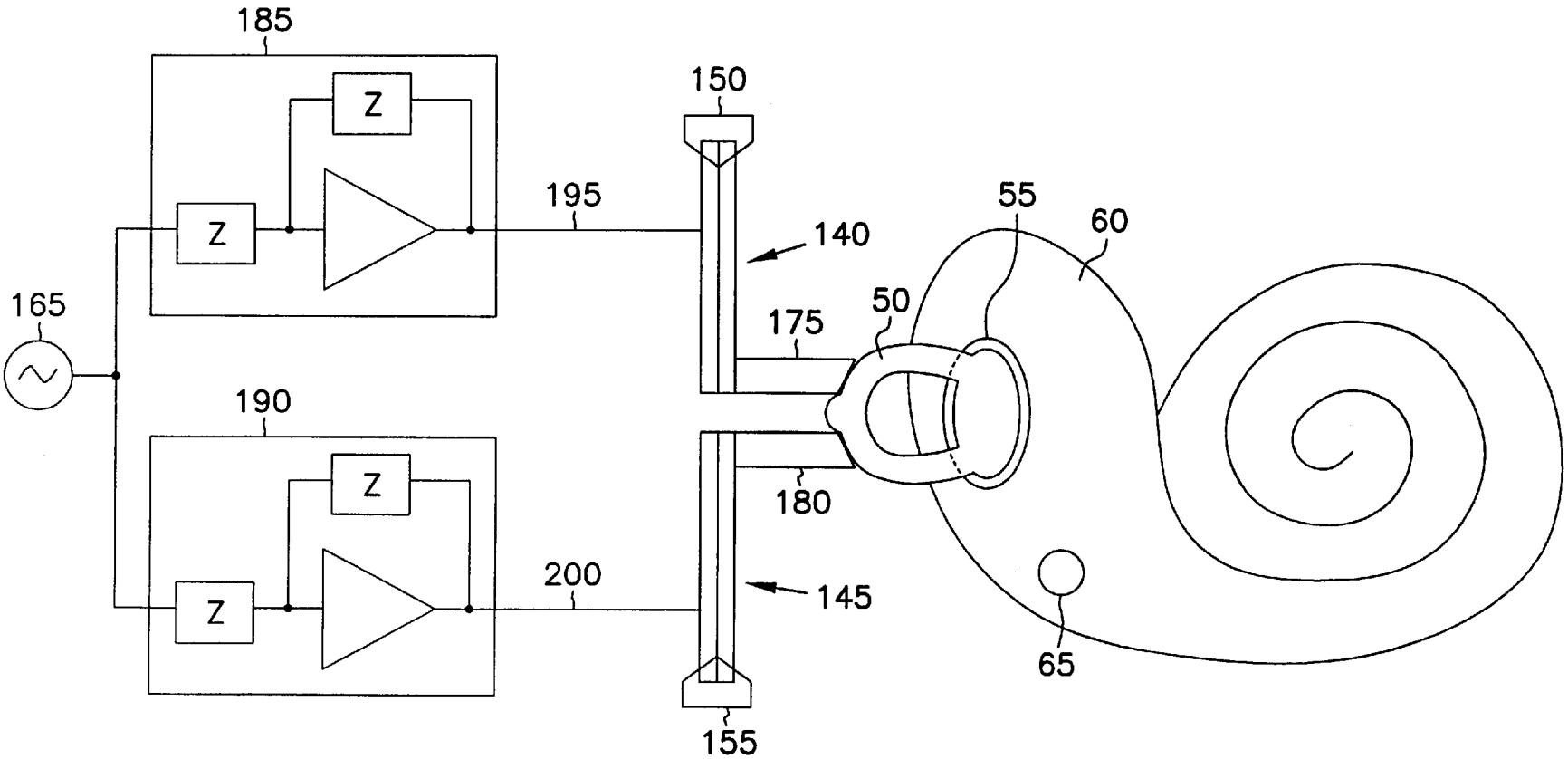
FIG. 5 illustrates generally indirect mechanical coupling to an auditory element such as the stapes by multiple piezoelectric transducers independently driven by multiple amplifiers.

FIG. 5 illustrates an alternative embodiment in which first and second piezoelectric transducers 140 and 145 each couple mechanical vibrations to an element of ossicular chain 37, such as the stapes 50, through optional first and second connecting elements 175 and 180 respectively. First and second connecting elements 175 and 180 each comprise a stiff wire, rod, or equivalent apparatus capable of coupling mechanical vibrations. Optional first and second connecting elements 175 and 180 may also be combined into a single element.

FIG. 5 also illustrates an alternative embodiment in which first and second amplifiers 185 and 190 each amplify an input electrical signal 165, and each provide an independent resulting amplified electrical signal to one of the first and second transducers 140 and 145 at nodes 195 and 200 respectively. This embodiment advantageously allows each of first and second piezoelectric transducers 140 and 145, having substantially nonidentical bandwidths, to receive an independent input electrical signal. Thus, the signal at node 195 optionally has frequency characteristics nonidentical to those at node 200. This embodiment also advantageously minimizes any electromechanical intercoupling between the first and second piezoelectric transducers 140 and 145.

Figure 6:
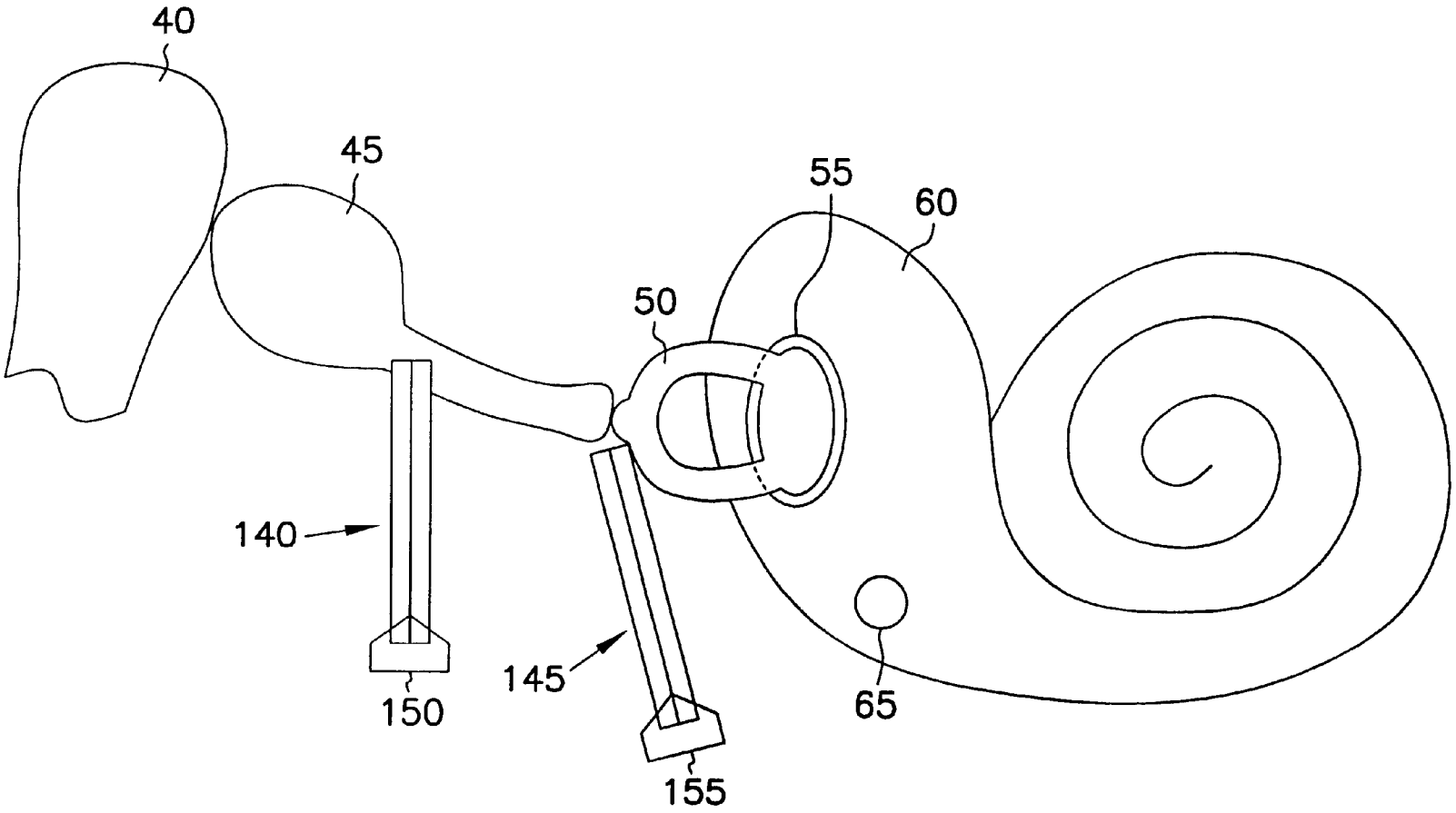
FIG. 6 illustrates generally mechanical coupling to multiple auditory elements such as the incus and stapes by multiple piezoelectric transducers.

In an alternative embodiment of FIG. 6, first and second piezoelectric transducers 140 and 145 are coupled to different ones of any of the elements of the ossicular chain 37, including malleus 40, incus 45, and stapes 50. In the particular embodiment of FIG. 6, a first piezoelectric transducer 140 is mechanically coupled to incus 45. A second piezoelectric transducer 145 is mechanically coupled to stapes 50. Mechanical coupling of the transducers to elements of the ossicular chain 37 may be effected directly or by using a single or multiple additional connecting elements. In one embodiment, the first and second piezoelectric transducers 140 and 145 are each provided an identical input electrical signal, as illustrated schematically in FIG. 4. In another embodiment, first and second piezoelectric transducers 140 and 145 each receive an independent input electrical signal, as illustrated schematically in FIG. 5.

Figure 7:
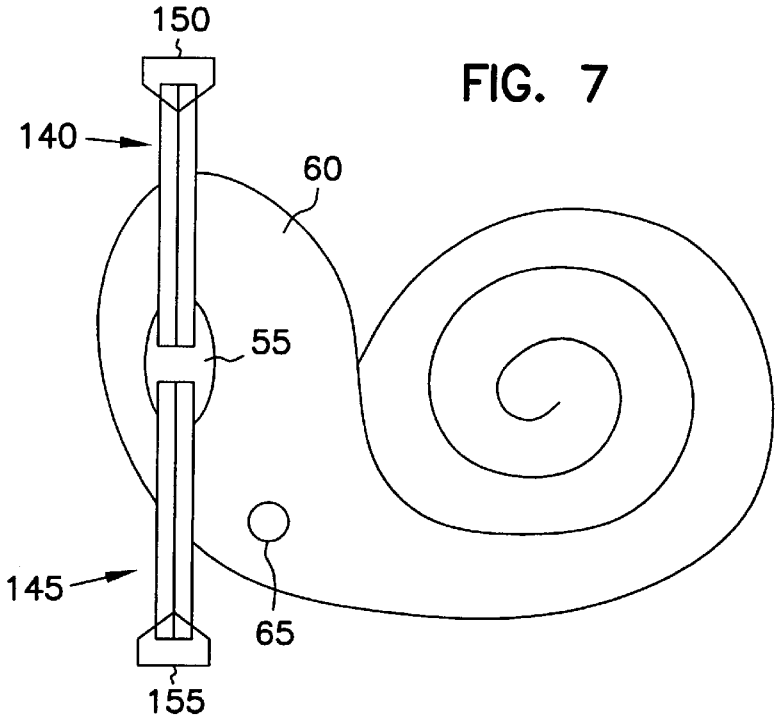
FIG. 7 illustrates generally mechanical coupling to the oval window of the cochlea by multiple piezoelectric transducers.

In an alternative embodiment of FIG. 7, first and second piezoelectric transducers 140 and 145 are each mechanically coupled to the oval window 55 portion of cochlea, either directly, or using a single or multiple additional connecting elements.

Figure 8:
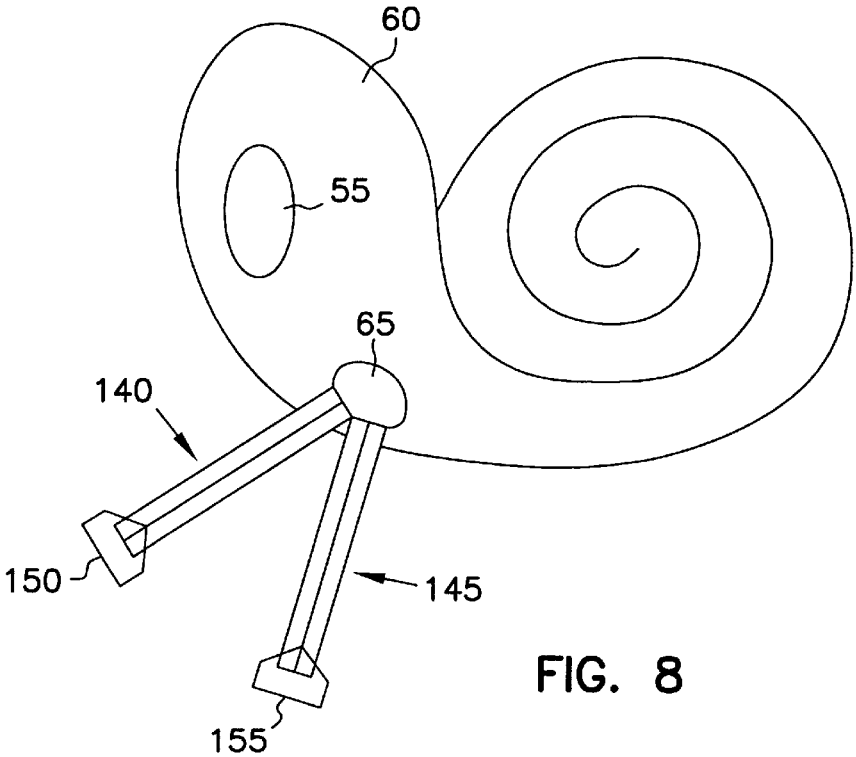
FIG. 8 illustrates generally mechanical coupling to the round window of the cochlea by multiple piezoelectric transducers.

In an alternative embodiment of FIG. 8, first and second piezoelectric transducers 140 and 145 are each mechanically coupled to the round window 65 portion of cochlea 60, either directly, or using single or multiple additional connecting elements.

Figure 9:
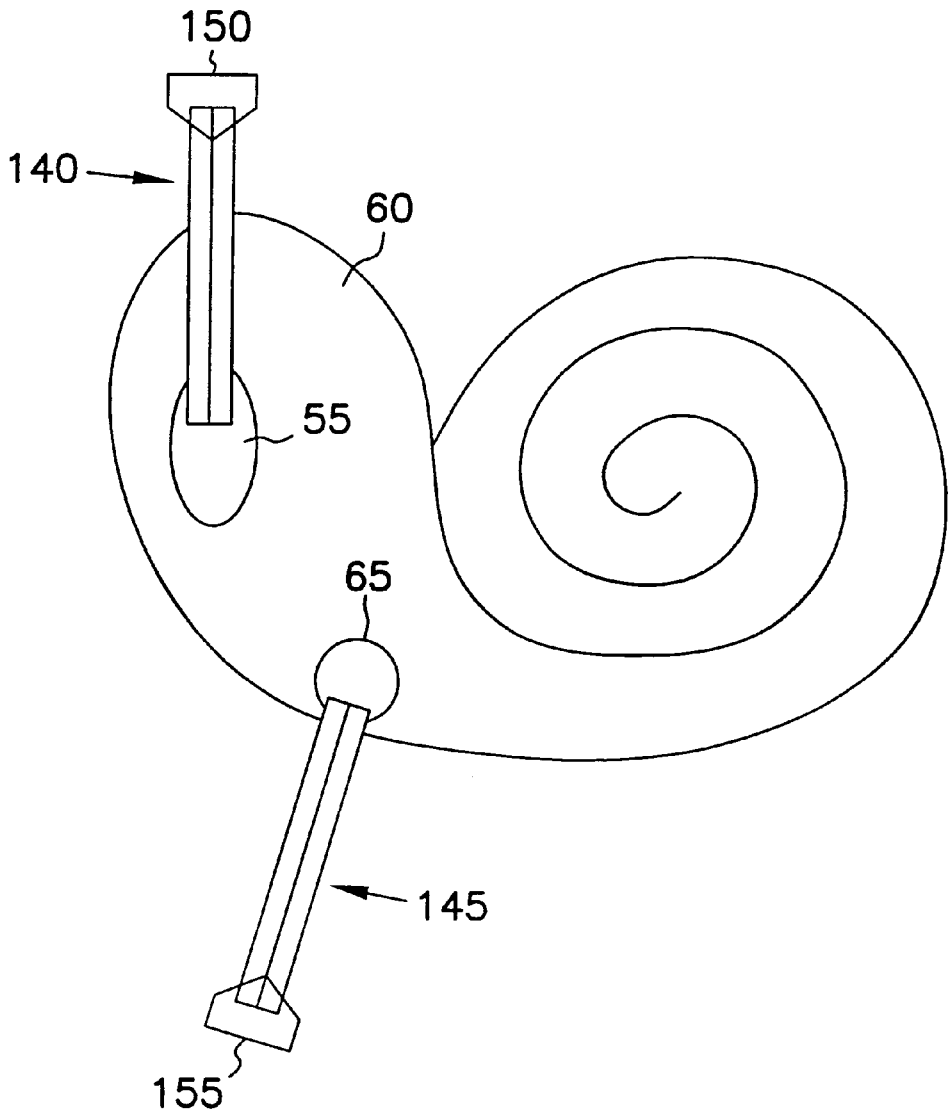
FIG. 9 illustrates generally mechanical coupling of a piezoelectric transducer to each of the oval and round windows of the cochlea.

In an alternative embodiment of FIG. 9, first piezoelectric transducer 140 is mechanically coupled to the oval window 55 portion of cochlea 60. Second piezoelectric transducer 145 is mechanically coupled to the round window 65 portion of cochlea 60. Mechanical coupling of the transducers may be effected directly or by using a single or multiple additional connecting elements. A combined mechanical coupling bandwidth results at cochlea 60 from the superposition of the substantially nonidentical bandwidths contributed by first and second piezoelectric transducers 140 and 145 at oval window 55 and round window 65 respectively.

Although FIGS. 7–9 illustrate mechanical coupling of piezoelectric transducers to the inner ear via the oval window 55 and round window 65 portions of cochlea 60, electrical-to-mechanical piezoelectric transducers may also be coupled to other portions of the inner ear, such as vestibule 61 or semicircular canals 62.

Figure 10:
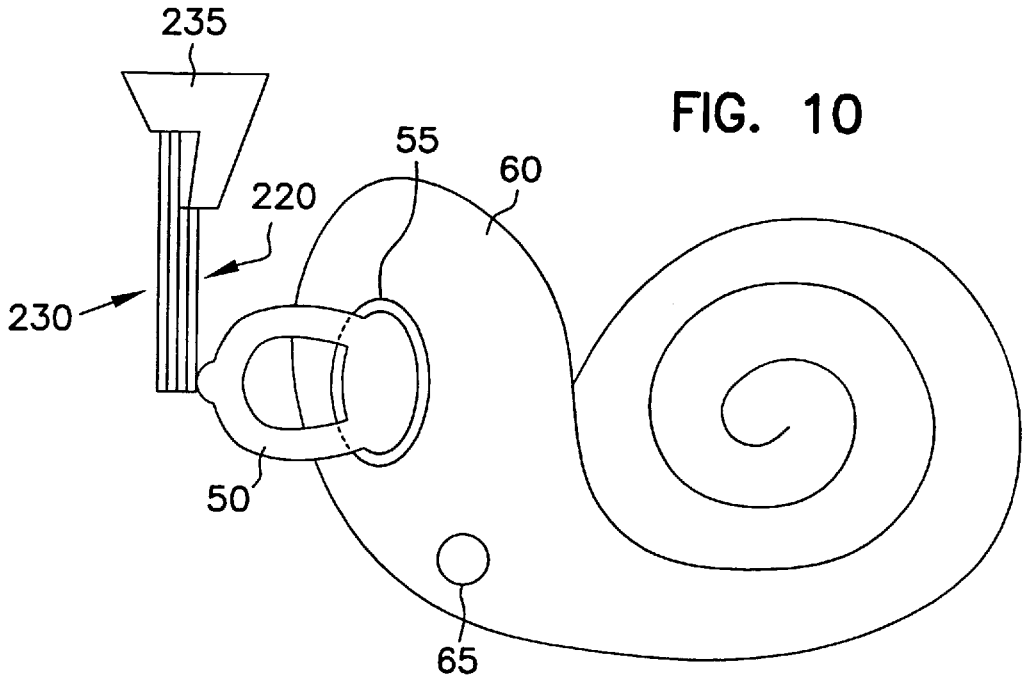
FIG. 10 illustrates generally mechanical coupling to an auditory element such as the stapes by multiple piezoelectric transducers in direct contact with each other.

FIG. 10 illustrates generally an alternative embodiment. A first piezoelectric transducer 220 is mechanically coupled to an element of ossicular chain 37, such as stapes 50. A second piezoelectric transducer 230 is mechanically coupled to first piezoelectric transducer 220 by direct contact. Optional bonding material couples first and second piezoelectric transducers 220 and 230. Mounting bracket 235 secures each of first and second piezoelectric transducers 220 and 230.

In one embodiment, first and second piezoelectric transducers 220 and 230 are bi-element transducers receiving respective input electrical signals of the same polarity. In this embodiment, piezoelectric elements that are more proximal to stapes 50, for each of first and second transducers 220 and 230, receive an electrical input signal of a first polarity. Piezoelectric elements that are more distal to stapes 50, for each of first and second transducers 220 and 230, receive an electrical input signal of a second polarity, opposite to the first polarity. First and second piezoelectric transducers 220 and 230 vibrate in concert in response to their input electrical signals.

The substantially nonidentical bandwidth of each of the first and second piezoelectric transducers 220 and 230 contributes to a combined bandwidth of vibration mechanically coupled to stapes 50 by first piezoelectric transducer 220, either by direct contact or through a single or multiple additional connection elements. Other configurations may be used to mechanically couple the first and second transducers 220 and 230 to effect a resulting combined mechanical vibration.

Figure 11:
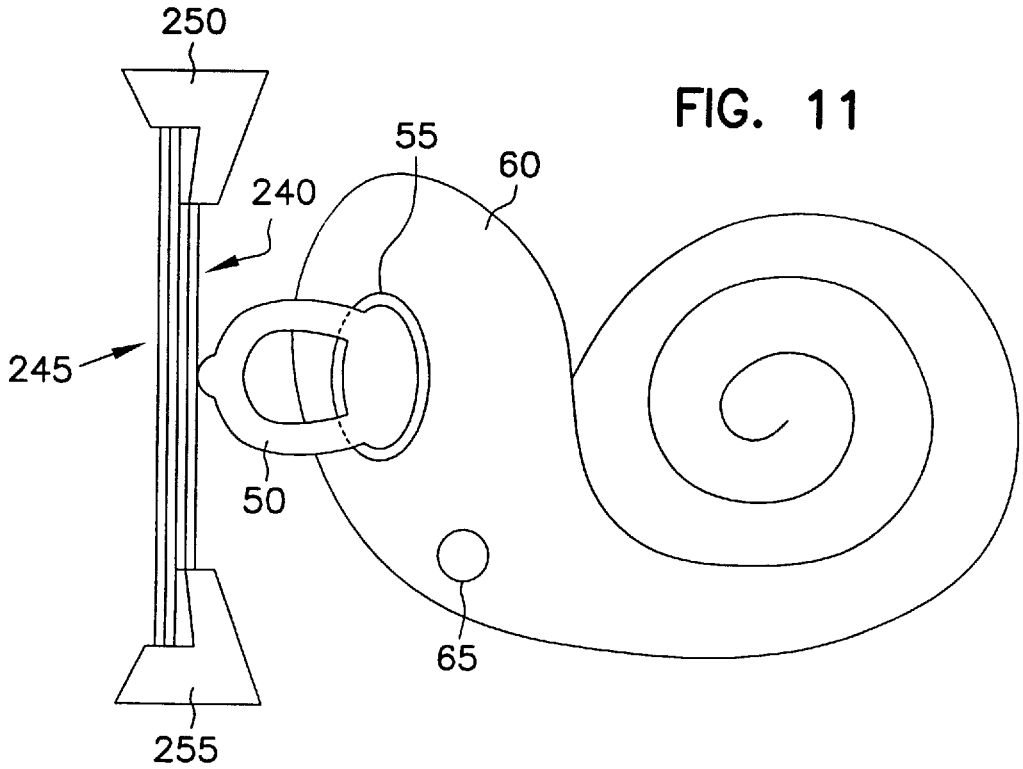
FIG. 11 illustrates generally mechanical coupling to an auditory element such as the stapes by multiple piezoelectric transducers affixed at multiple points.

Though FIGS. 3–10 illustrate piezoelectric transducers which are affixed to a base or mounting bracket at a single proximal end, the piezoelectric transducers may be affixed at more than one location. In FIG. 11, for example, a first piezoelectric transducer 240 is mechanically coupled to an element of ossicular chain 37, more particularly stapes 50. A second piezoelectric transducer 245 is mechanically coupled to first piezoelectric transducer 240 as described with respect to FIG. 10. Mounting bracket 250 secures a proximal end of each of first and second piezoelectric transducers 240 and 245. Mounting bracket 255 secures a distal end of each of first and second piezoelectric transducers 240 and 245. Mounting brackets 250 and 255 may also be formed as a unitary piece.

The mechanical coupling of first piezoelectric transducer 240 to stapes 50 is preferably effected approximately at the midpoint between its proximal and distal ends, or at another convenient location on transducer 240, allowing a combined mechanical vibration of each of first and second piezoelectric transducers 240 and 245 in response to an input electrical signal such as described above with respect to FIG. 10. The substantially nonidentical bandwidth of each of the first and second piezoelectric transducers 240 and 245 contributes to a combined bandwidth of vibration mechanically coupled to stapes 50 by first piezoelectric transducer 240, either by direct contact or through a single or multiple additional connection elements. A piezoelectric transducer may also be affixed at more than two locations.

The embodiment of FIG. 11 advantageously allows additional mechanical support since each of first and second piezoelectric transducers 240 and 245 are affixed at more than one location. This embodiment also allows additional flexibility in selecting sensitivity and frequency characteristics since the effective length is approximately reduced to a distance between either of a proximal or distal end of the first piezoelectric transducer 240 and the point of mechanical coupling to the stapes 50. In particular, the bandwidth of any first piezoelectric transducer affixed at more than one location may be used in conjunction with the bandwidth of any other piezoelectric transducer affixed at a single location to obtain an increased combined bandwidth.

Figure 12:
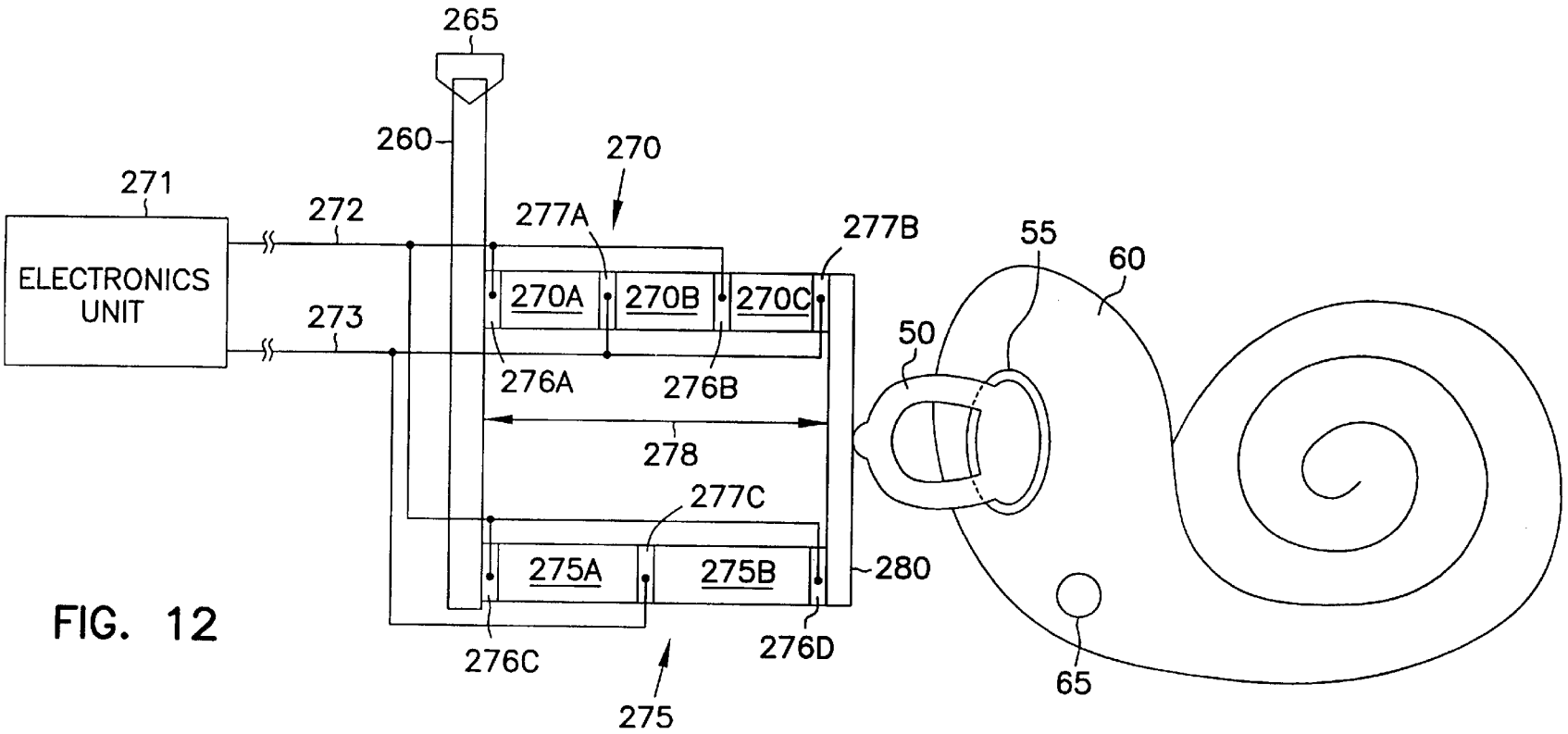
FIG. 12 illustrates generally mechanical coupling to an auditory element such as the stapes by multiple piezoelectric stacked transducers.

FIG. 12 illustrates generally an alternative embodiment in which a plurality of ceramic piezoelectric stacked transducers vibrates stapes 50 with a combined effective bandwidth. Each stacked transducer comprises multiple piezoelectric transducer elements in an arbitrary but selectable number. Support 260 extends outwardly from mount 265, which is secured to the temporal bone. First and second stacked transducers 270 and 275, having substantially nonidentical bandwidths, each extend approximately radially outward from support 260, and are mutually mechanically coupled to stapes 50 by bracket 280.

Piezoelectric transducer elements 270A–C and 275A–B of respective stacked transducers 270 and 275, are electrically wired in parallel for receiving an electrical input signal from electronics unit 271 through lead wires 272 and 273, coupled to respective connection points 276A–D and 277A–C. Thus, the electrical input signal is received across a length of each transducer element 270A–C and 275A–B, and each stacked transducer 270 and 275 has a combined length 278. This embodiment uses a piezoelectric effect with displacement in the same direction as the applied electrical input signal, although a piezoelectric effect in another direction may also be used at the designer's discretion by rearranging the connection points accordingly. In this embodiment, in response to the received electrical input signal, the length of each transducer element 270A–C and 275A–B varies, causing a relatively larger variation in combined length 278. The exact number of stacked transducer elements 270A–C and 275A–B is selected, in part, to meet a desired variation in combined length 278. The combined bandwidth of first stacked transducer elements 270A–C is selected to be substantially nonidentical from the combined bandwidth of the second stacked transducer elements 275A–B, either by using different numbers of stacked elements or any other technique.

Figure 13:
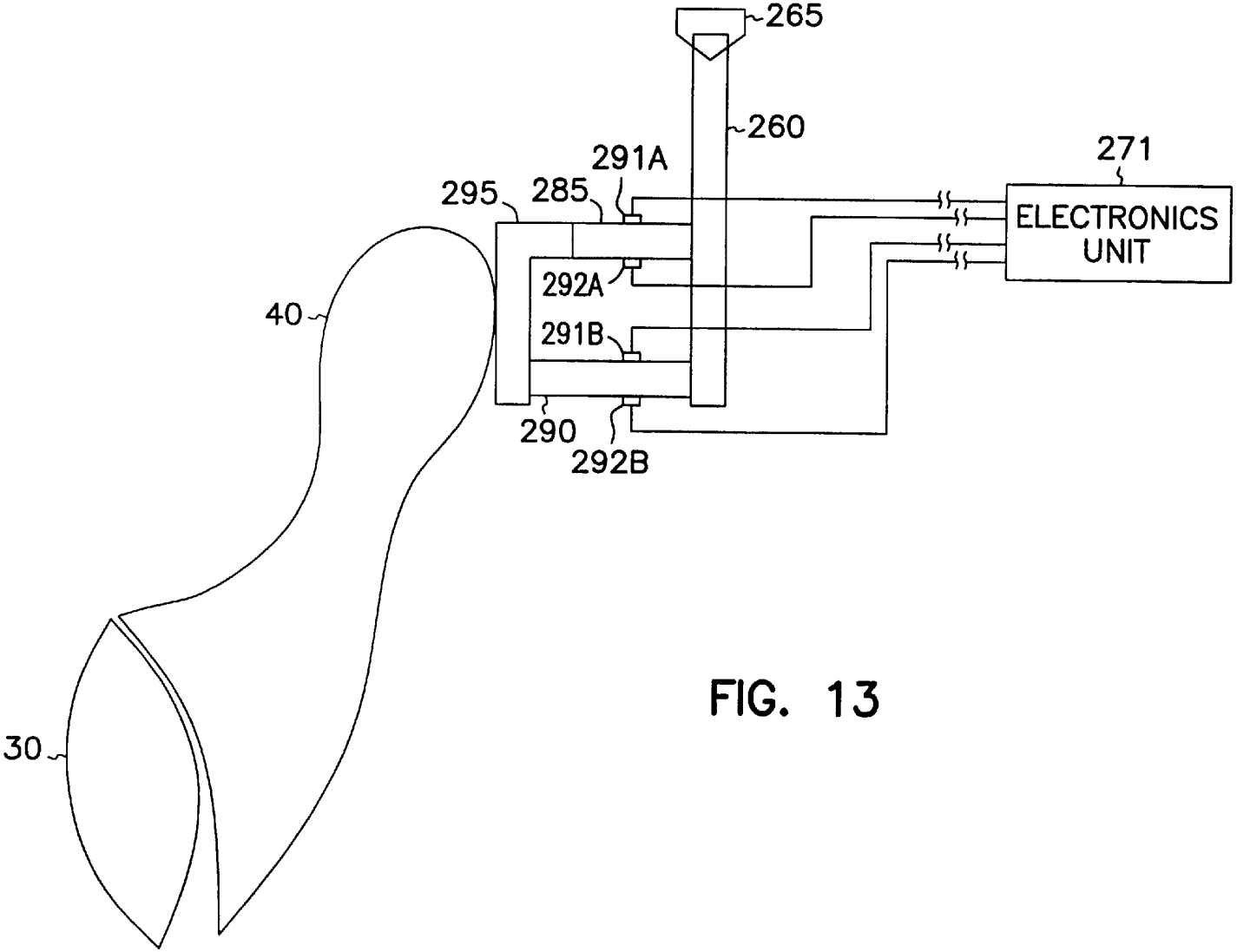
FIG. 13 illustrates generally mechanical coupling to an auditory element such as the malleus by multiple ceramic piezoelectric single element transducers for sensing mechanical vibrations.

FIG. 13 illustrates generally an alternative embodiment for sensing mechanical vibrations of an auditory element such as malleus 40 using mechanical-to-electrical transducers. Support 260 extends outwardly from mount 265, which is secured to the temporal bone. First and second ceramic piezoelectric single element transducers 285 and 290, having substantially nonidentical mechanical-to-electrical bandwidths, each extend approximately radially outward from support 260, and are mutually mechanically coupled to malleus 40 by bracket 295.

In one embodiment, bracket 295 is shaped to accommodate a difference in lengths of first and second ceramic piezoelectric single element transducers 285 and 290 such that substantially nonidentical bandwidths are obtained. Other techniques of obtaining substantially nonidentical bandwidths may also be used to obtain a combined bandwidth from multiple mechanical-to-electrical transducers.

This embodiment uses a piezoelectric effect having a displacement approximately orthogonal to the direction of the transduced electrical signal, although a piezoelectric effect in another direction may also be used at the designer's discretion by rearranging the connection points accordingly. In this embodiment, sensed mechanical vibrations in a direction approximately orthogonal to support 260 are transduced into electrical signals received across a thickness, approximately parallel to support 260, of each of transducers 285 and 290. The electrical signals are received at connection points 291A–B and 292A–B, and are provided through respective lead wires 293 and 294 to an electronics unit 271 of an implantable hearing aid for summing and further processing. Vibrations may also be sensed from other auditory elements, including tympanic membrane 30 and incus 45.

Figure 14:
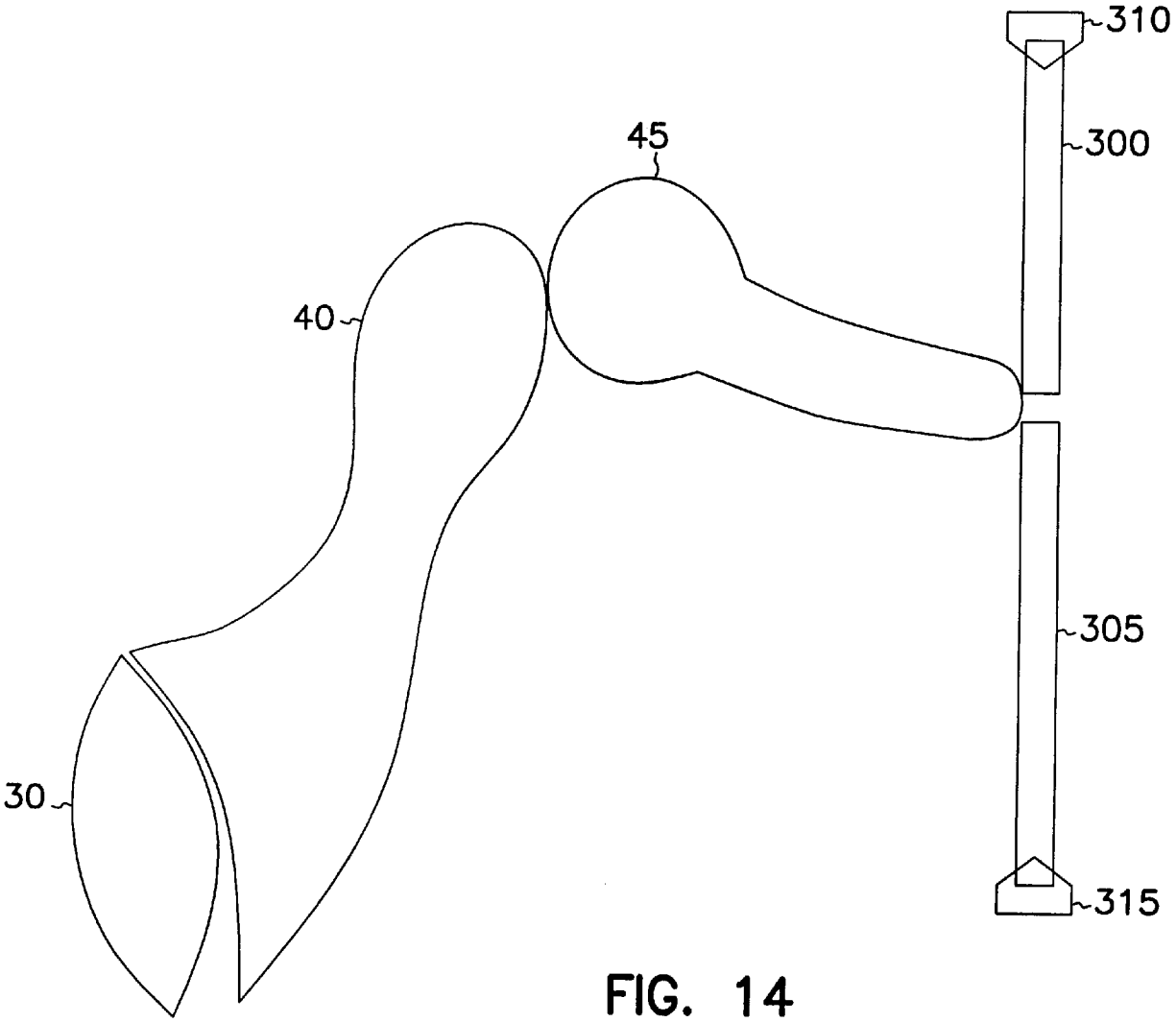
FIG. 14 illustrates generally mechanical coupling to an auditory element such as the incus by multiple piezoelectric film transducers for sensing mechanical vibrations.

FIG. 14 illustrates generally an alternative embodiment for sensing mechanical vibrations of an auditory element, such as incus 45, using mechanical-to-electrical transducers such as the piezoelectric film transducers described above. First and second film transducers 300 and 305, having substantially nonidentical mechanical-to-electrical bandwidths, each extend outwardly from respective first and second mounts 310 and 315, which are each secured to the temporal bone. Ends of first and second film transducers 300 and 305 that are distal to respective first and second mounts 310 and 315, are mechanically coupled, and optionally affixed to an auditory element such as incus 45. Mechanical vibrations of incus 45 are transduced into respective electrical signals received across a thickness of each of first and second film transducers 300 and 305. The electrical signals are provided to an electronics unit of an implantable hearing aid for summing and further processing. A combined mechanical-to-electrical bandwidth of first and second film transducers 300 and 305 results from their substantially nonidentical individual bandwidths.

Figure 15:
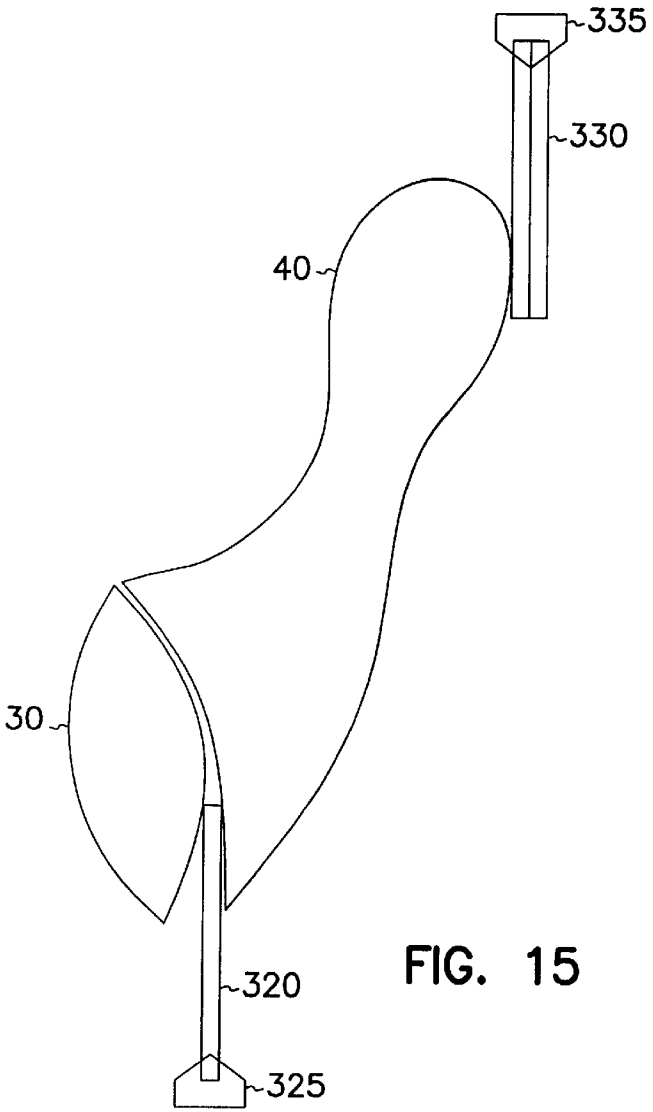
FIG. 15 illustrates generally mechanical coupling to multiple auditory elements such as the tympanic membrane and the malleus by multiple piezoelectric transducers, having different material properties, for sensing mechanical vibrations.

FIG. 15 illustrates generally an alternative embodiment for sensing mechanical vibrations of multiple auditory elements such as tympanic membrane 30 and malleus 40 using mechanical-to-electrical transducers having different material properties. First transducer 320 is a piezoelectric film transducer, as described above, extending outwardly from mount 325 secured to the temporal bone. First transducer 320 is mechanically coupled to tympanic membrane 30 for receiving mechanical vibrations. Second transducer 330 is a bi-element transducer, as described above, extending outwardly from mount 335 secured to the temporal bone. Second transducer 330 is mechanically coupled to malleus 40 for receiving mechanical vibrations.

In this embodiment, first and second transducers 320 and 330 have substantially nonidentical mechanical-to-electrical frequency responses obtained from their different material properties, different physical dimensions, different auditory elements to which they are coupled, or other technique of obtaining different frequency responses. A combined mechanical-to-electrical bandwidth of first and second film transducers 320 and 330 results from their substantially nonidentical individual bandwidths.

Although FIGS. 4–15 depict particular configurations of multiple piezoelectric transducers, at least portions of these configurations or the inventive concepts taught therein may be used in combination. Additional connection elements may be used to effect mechanical coupling. For example, mechanical coupling via a single or multiple rods or stiff wires may be used in place of mechanical coupling by direct contact. Although the illustrations each depict only pairs of piezoelectric transducers for clarity, the invention includes any plurality of such transducers. Furthermore, multiple locations of the piezoelectric transducers may be affixed by mounting brackets or a variety of equivalent means disposed within the middle ear.

FIGS. 4–15 depict mechanical coupling between piezoelectric transducers and anatomically normal elements of ossicular chain 37. However, ossicular reconstruction or other techniques may replace individual or collective elements of ossicular chain 37, including malleus 40, incus 45, and stapes 50, with prosthetic elements. The invention is intended to include coupling between piezoelectric transducers and any such prosthetic elements.

The invention has been described, for clarity of illustration, with respect to P-MEI and T-MEI hearing aid systems. However, the invention may be used with other types of hearing systems as well, such as a cochlear implant or other inner ear hearing aid system. In particular, the mechanical-to-electrical piezoelectric input transducers disclosed in the invention may be used in conjunction with a cochlear implant. In such an embodiment, the piezoelectric input transducers could be used to transduce mechanical vibrations produced by sound into electrical signals which are processed and provided as output electrical stimuli to cochlea 60.

Thus, the present invention discloses a method and apparatus for improving a frequency response of a piezoelectric transducer, or any other type of electromechanical transducer used in an implantable hearing system. The present invention configures a plurality of piezoelectric transducers having substantially nonidentical frequency responses. A combined frequency response effected by the plurality of piezoelectric transducers is thereby optimized.

What is claimed is:

1. A fully implantable apparatus for improving hearing in a human within an audible rang of about 250 hz to about 5 KHz, the apparatus comprising:

(a) signal driver means adapted to be located substantially within the middle ear region of the patient, said signal driver means responsive to input from a vibrating auditory element to produce a first output signal and a second output signal;

(b) a plurality of piezo-electric transducers each having at least two bonded vibrating elements adapted to be placed in the middle ear region, said plurality of transducers comprising at least a first and a second piezo-electric transducer each having respective first and second output bandwidths, the first transducer having a substantially different bandwidth than the second transducer, and the first and second transducers producing mechanical vibration frequency responses in response to said signal driver first output signal and said second output signal; and (c) means for positioning said transducers within the middle ear region proximate an auditory element within either the middle ear or the inner ear so that a portion of the vibrating transducer bonded elements is in direct contact with the auditory element, thereby forming a combined and direct output mechanical vibration comprising a superposition of the first and second mechanical vibration bandwidths.

2. The apparatus of claim 1, in which the signal driver means further comprises a plurality of electronic amplifier circuits, with each circuit coupled to at least one transducer.

3. The apparatus of claim 1, in which the first and second piezo-electric transducers are mechanically coupled.

4. The apparatus of claim 1, in which at least one of the piezo-electric transducers is a film piezo-electric transducer.

5. The apparatus of claim 1, in which at least one of the piezo-electric transducers is a ceramic piezo-electric transducer.

6. The apparatus of claim 1, in which at least one of the piezo-electric transducers is a stacked piezo-electric transducer having multiple frequency responses within a range of between about 250 Hz to about 5 kHz.

7. The apparatus of claim 1, in which the first and second transducers have at least one substantially non-identical physical characteristic.

8. A fully implantable apparatus for improving hearing in a human within an audible range of about 250 hz to about 5 KHz, the apparatus comprising:

(a) signal driver means adapted to be located substantially within the middle ear region of the patient, said signal driver means responsive to input from a vibrating auditory element to produce a first output signal and a second output signal;

(b) a plurality of piezo-electric transducers each having at least two bonded vibrating elements adapted to be placed in the middle ear region, said plurality of transducers comprising at least a first and a second piezo-electric transducer each having respective first and second output bandwidths, the first transducer having a substantially different bandwidth than the second transducer, and the first and second transducers producing mechanical vibration frequency responses in response to said signal driver first output signal and said second output signal;

(c) amplifier circuit means for amplifying an input electrical signal, comprising a plurality of electronic amplifier output circuits, with each electron amplifier output circuit electronically coupled to at least one transducer of said plurality of transducers; and (d) means for positioning said transducers within the middle ear region proximate an auditory element within either the middle ear or the inner ear so that a portion of the vibrating transducer bonded elements is in direct contact with the auditory element, thereby forming a combined and direct output mechanical vibration comprising a superposition of the first and second mechanical vibration bandwidths.

9. The apparatus of claim 8, in which the piezo-electric transducers are a stacked piezo-electric transducer having a multiple frequency responses within a range of between about 250 Hz to about 5 kHz.

10. The apparatus of claim 8, in which the first and second piezo-electric transducers are mechanically coupled.

11. The apparatus of claim 8, in which at least one of the piezo-electric transducers is a ceramic piezo-electric transducer.

12. The apparatus of claim 8, in which at least one of the piezo-electric transducers is a film piezo-electric transducer.

13. The apparatus of claim 8, in which the first and second transducers have at least one substantially non-identical physical characteristic.

14. A fully implantable apparatus for improving hearing in a human within an audible range of about 250 hz to about 5 KHz, the apparatus comprising:

(a) signal driver means adapted to be located substantially within the middle ear region of the patient, said signal driver means responsive to an electrical signal input to produce a first output signal and a second output signal;

(b) a stacked piezo-electric transducer comprising a plurality of piezo-electric transducers each having at least two bonded vibrating elements adapted to be placed in the middle ear region, said plurality of transducers comprising at least a first and a second piezo-electric transducer each having respective first and second output bandwidths, the first transducer having a substantially different bandwidth than the second transducer, and the first and second transducers producing mechanical vibration frequency responses in response to said signal driver first output signal and said second output signal;

(c) amplifier circuit means for amplifying an input electrical signal comprising a plurality of electronic amplifier output circuits, with each electron amplifier output circuit coupled to at least one transducer of said plurality of transducers; and (d) means for positioning said stacked piezo-electric transducer within the middle ear region proximate an auditory element within either the middle ear or the inner ear so that a portion of the vibrating transducer bonded elements is in direct contact with the auditory element, thereby forming a combined and direct output mechanical vibration comprising a superposition of the first and second mechanical vibration bandwidths within a normal human audible frequency range of about 250 Hz to about 5 kHz.

15. The apparatus of claim 14, in which at least one of the piezo-electric transducers is a film piezo-electric transducer.

16. The apparatus of claim 14, in which at least one of the piezo-electric transducers is a ceramic piezo-electric transducer.

* * * * *